United States Patent [19]

Lentz et al.

[11] Patent Number: 5,061,141

[45] Date of Patent: Oct. 29, 1991

[54] METHOD AND APPARATUS FOR PRODUCING CAN BODIES

[75] Inventors: Norbert Lentz; Harald Schmidt, both of Essen, Fed. Rep. of Germany

[73] Assignee: Fried. Krupp Gesellschaft mit beschränkter Haftung, Essen, Fed. Rep. of Germany

[21] Appl. No.: 330,178

[22] Filed: Mar. 29, 1989

[30] Foreign Application Priority Data

Mar. 29, 1988 [DE] Fed. Rep. of Germany ..... 3810611

[51] Int. Cl.[5] ..... B21D 7/08; B21D 9/04

[52] U.S. Cl. ..... 413/72; 413/74; 72/52

[58] Field of Search ..... 413/69–77; 72/52; 219/64

[56] References Cited

U.S. PATENT DOCUMENTS

| | | | |
|---|---|---|---|
| 11,533 | 4/1896 | Hume | 413/74 |
| 1,190,351 | 7/1916 | Wilsie | 72/52 |
| 2,177,104 | 10/1939 | Gonser | 413/69 |
| 2,432,490 | 12/1947 | Seltzer . | |
| 2,864,933 | 12/1958 | Smith . | |
| 2,923,304 | 2/1960 | Vitense et al. . | |
| 3,124,872 | 3/1964 | Knodel, Jr. . | |
| 3,139,012 | 6/1964 | Senfleben . | |
| 3,430,410 | 3/1969 | Heisler . | |
| 4,530,225 | 7/1985 | Meurer et al. | 72/52 |

FOREIGN PATENT DOCUMENTS

| | | |
|---|---|---|
| 3330171 | 2/1984 | European Pat. Off. . |
| 0215404 | 3/1987 | European Pat. Off. . |
| 2947445 | 6/1980 | Fed. Rep. of Germany . |
| 3534195 | 12/1986 | Fed. Rep. of Germany . |
| 1143161 | 2/1969 | United Kingdom . |

*Primary Examiner*—Frederick R. Schmidt
*Assistant Examiner*—Jack Lavinder
*Attorney, Agent, or Firm*—Spencer & Frank

[57] ABSTRACT

A method and apparatus for producing can bodies, wherein blanks are laterally centered after removal from a magazine, are engaged in the center of their rear edge and are transported into a shaping station in which initially the center section of the blank is bent into its final shape. While doing this, a central force and friction lock is produced between a transporting means and the deformed blank to realize reliable guidance of the already partially bent blank. To further transport the blank, it is contacted at its rear edge in the already completely bent region by two lateral transporting devices and is advanced to a seam forming station, while the opposite longitudinal edges of the blank are brought to an adjoining relationship.

22 Claims, 7 Drawing Sheets

METHOD AND APPARATUS FOR PRODUCING CAN BODIES

This application claims the priority of Federal Republic of Germany Application P 38 10 611.6 filed Mar. 29th, 1988, which is incorporated herein by reference.

BACKGROUND OF THE INVENTION

The patent invention relates to a method of producing can bodies from individual, planar, cut blanks and to an apparatus for implementing the method. Generally, round can bodies having a longitudinal seam can be produced according to two methods. In the first, each can is produced from an individual cut blank. According to the second, each can is cut from an elongated tube produced from a long flat band.

If the can bodies are produced from individual cut blanks, these pieces are individually taken from a magazine and are sent at a high speed through a rounding machine such as that taught in German Patent Document ("Offenlegnngsschrift") 3,330,171 in which the planar cut blank is converted to a round preform. At the end of the bending process, the bent cut blank drops into a collecting tray where it is quickly decelerated to a temporary stop. The rounded cut blank is then accelerated out of the transfer region of the rounding machine in its own axial direction, i.e. at 90° to the direction of movement of the planar cut blank into the rounding machine, and is transported, generally at a noticeably higher speed than the joining speed, out of the collecting tray into a guide rail enclosed by a guiding device and further into a joining station.

The mode of operation of the rounding machine is divided into two distinct operations, forming can bodies and removing them from the collecting tray. The machine alternates between the bending and removal operations, accelerating the blank in one direction, stopping the blank and then accelerating the blank in a second direction. This mode of operation with constant deceleration by hard impact and sudden acceleration creates a high noise level. Moreover, due to the constant change from the rounding process to removal of the cut blank from the collecting tray, the output quantity of the machine is limited.

The production of long tubes having a welded longitudinal seam which are subsequently separated into individual can bodies in a separating station is taught, for example, in German Patent Document ("Offenlegnngschrift") 2,947,445. For shaping, a band is drawn through an outer, closed shaping tool which converges in the form of a funnel from a wider intake opening to an outlet opening which has a diameter corresponding to the can diameter. Although the continuous shaping of a band actually has great advantages with respect to noise production and with respect to the end result, problems do arise in creating the forces required to pull the sheet metal through the forming apparatus and to act on the exterior of the sheet metal.

In this process, before shaping and seam formation, the band may be provided with scoring lines corresponding to the length of the cans, with the separation into individual can bodes occurring in a separation station such as that taught in U.S. Pat. No. 3,430,410.

The shaping of individual blanks in an outer, funnel-shaped tool is difficult. The force of the shaping tool easily warps the can bodies and thus makes precise guidance impossible. Additionally, it is difficult to pull the cut blanks whose length is short compared to the length of the outer shaping tool because of interference between the shaping tool and the pulling mechanism.

SUMMARY OF THE INVENTION

It is an object of the present invention to provide a method and an apparatus for producing can bodies having a longitudinal seam from individual, planar, cut blanks wherein noise can be reduced and/or output can be increased.

This object and others to become apparent as the specification progresses, are accomplished by the invention, according to which, briefly stated, the method of producing can bodies from individual, planar cut blanks includes the following steps: transporting the blank by a conveyor into a shaping station; bending, to a final shape, solely the center region of the blank around an inner shaping mandrel to a circumferential angle of 120° to 190° while leaving the lateral regions unbent; engaging, simultaneously with the bending step, the central portion between the mandrel and the conveyor by friction forces derived from the deformed center region; additionally bending, after the first bending step, the lateral regions of the blank; guiding opposite longitudinal side edges of the blank into an adjoining position; forming a longitudinal seam along the adjoining side edges; and continuously advancing the blank during the above steps.

The continuous transporting in one direction and essentially simultaneous bending of the can body eliminates the noisy deceleration and acceleration processes. Since a cut blank can be reliably centered by lateral guides essentially only when it is in a planar state, the invention provides that, at the onset of the bending process, the blank is centered and a force and friction lock is established between the transporting means and the cut blank which ensures further guidance of the pre-centered cut blank. Further lateral engagement with the cut blank is provided at a location on the cut blank which, with reference to the circumference of the can body to be formed, is already bent to its final shape. This ensures that no relative movement between the cut blank and the transporting mechanism occurs. Moreover, the completely bent part of the cut blank can also be laterally supported and guided while it is being transported.

Further advantages of the present invention include providing an advantageous circumferential angle for the completely bent center region of the cut blank before it is gripped laterally and engaging the blank over a sufficient portion of its length to ensure stability of the guidance of the cut blank in its plane.

The apparatus for implementing the method includes transporting means configured to engage the bent blank. A pawl of a transporting means engaging the blank, travels through a central recess provided at the underside of a shaping mandrel, thus ensuring reliable transportation of the cut blank through the shaping tool. When the cut blank is bent around the shaping mandrel, the central region of the cut blank is pressed slightly downwardly into the elastic supports of the transporting means. This produces a friction lock which results in positive lateral stability during guidance of the cut blank through the shaping tool. To guide the cut blank into the shaping tool in an accurately aligned state, a plane is provided on which the cut blanks are centered by outer guide rails. Since friction increases during further passage through the shaping tool, the apparatus is further provided with two lateral, revolving transporting means which are equipped with non-elastic pawls so as to laterally guide and support the already completely bent region of the cut blank.

The one central recess at the underside of the shaping mandrel may also be provided with symmetrically arranged recesses in which further parts off the pawl can engage.

According to one embodiment of the present invention, the lateral transporting means are preferably arranged in a single plane.

An advantageous configuration for the shaping mandrel includes individual guide rods with the central recess in the shaping mandrel being formed by the space between two adjacent guide rods in a lower position. Further recesses may then be formed by the spaces between correspondingly adjacent guide rods.

To be able to adapt the shaping mandrel precisely to the can body to be produced, the lower and upper sets of guide rods are made adjustable in height relative to one another.

The outer shaping tool can advantageously be comprised of guide rods, at least in its first section. It is advantageous to form the plane disposed in front of the shaping tool of the same guide rods, providing an edge-free transition. Separate guide rods can also be employed instead of continuous guide rods as long as transition interference is minimized.

To provide the broadest possible elastic supports, the transporting means disposed below the shaping mandrel, in its longitudinal center plane, can be configured as a double roller chain.

DESCRIPTION OF THE PREFERRED EMBODIMENT

Figure 1:
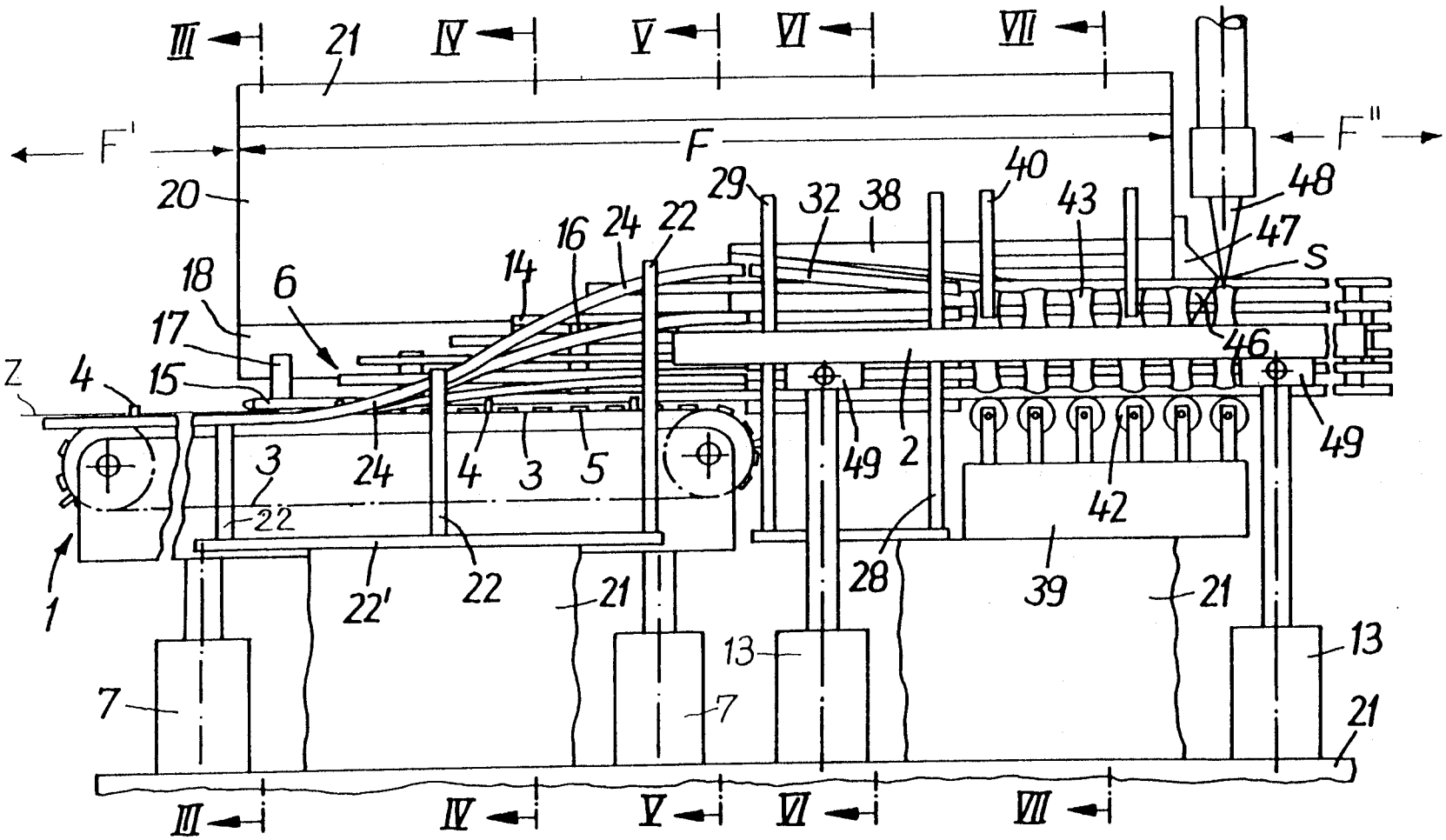
FIG. 1 is a side elevational view of a preferred embodiment of the invention.

FIG. 1 illustrates an apparatus for transporting and guiding cut can blanks Z and for shaping them into can bodies which extends over a shaping path F and over guide paths F' and F" upstream and downstream of the shaping path F, respectively. The shaping path includes a first transporting device 1 and a second transporting device 2, an inner shaping mandrel 6, an outer shaping cage including rod-shaped and roller-shaped outer shaping and guiding tools 24, 25, 31, 32, 33, 42, 43 and 44 also illustrated in FIG. 2, as well as a grooved rail 38. The first transporting device 1 feeds in the cut can blanks Z from a known magazine stack remover, not illustrated, and transfers them, approximately in the center of shaping path F, to the second transporting device 2.

First transporting device 1 is essentially composed of a double roller chain 3 equipped with pawls 4 and elastic chain supports 5 and is disposed in the longitudinal center plane M of the shaping and guiding tools. In order to set the transporting device 1 to different can diameters D and to set the distance between chain supports 5 and the shaping mandrel 6, which depend on the can diameter, transporting device 1 can be adjusted in height by means of lifting elements 7.

Figure 2:
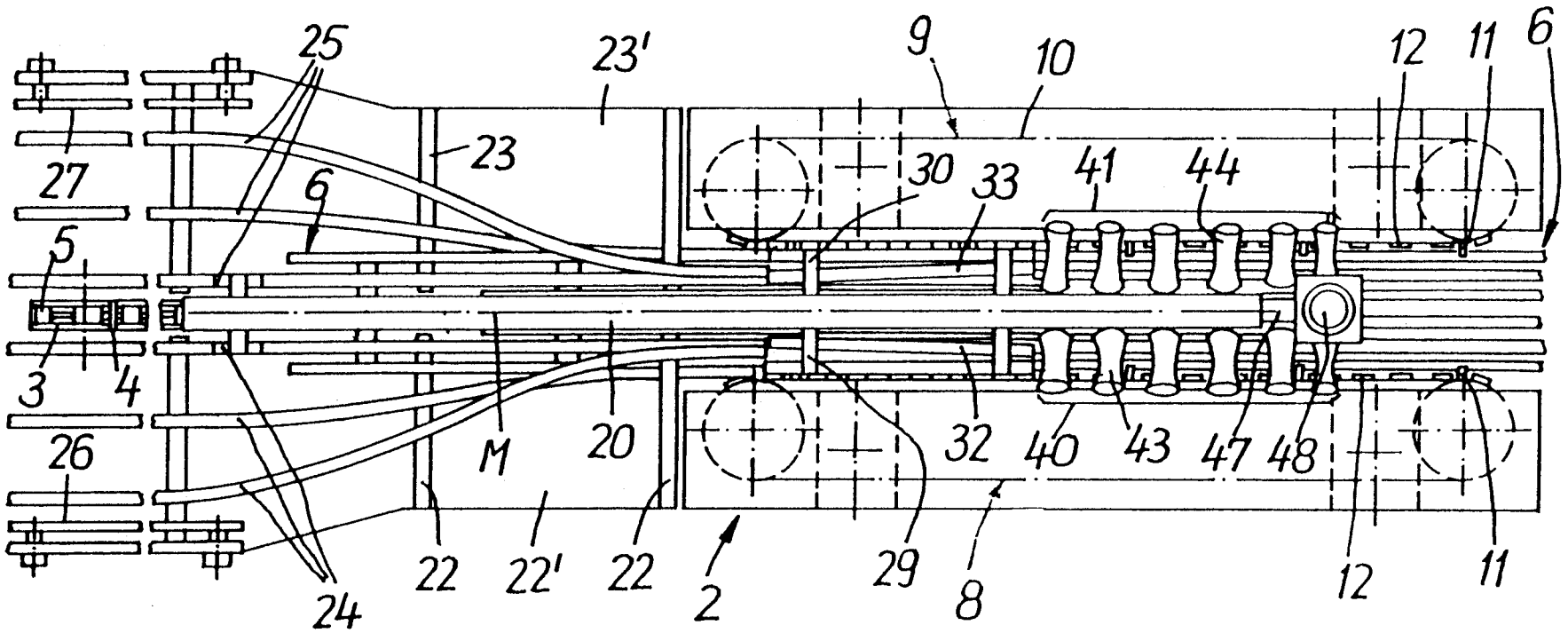
FIG. 2 is a top plan view of the preferred embodiment.
Figure 6:
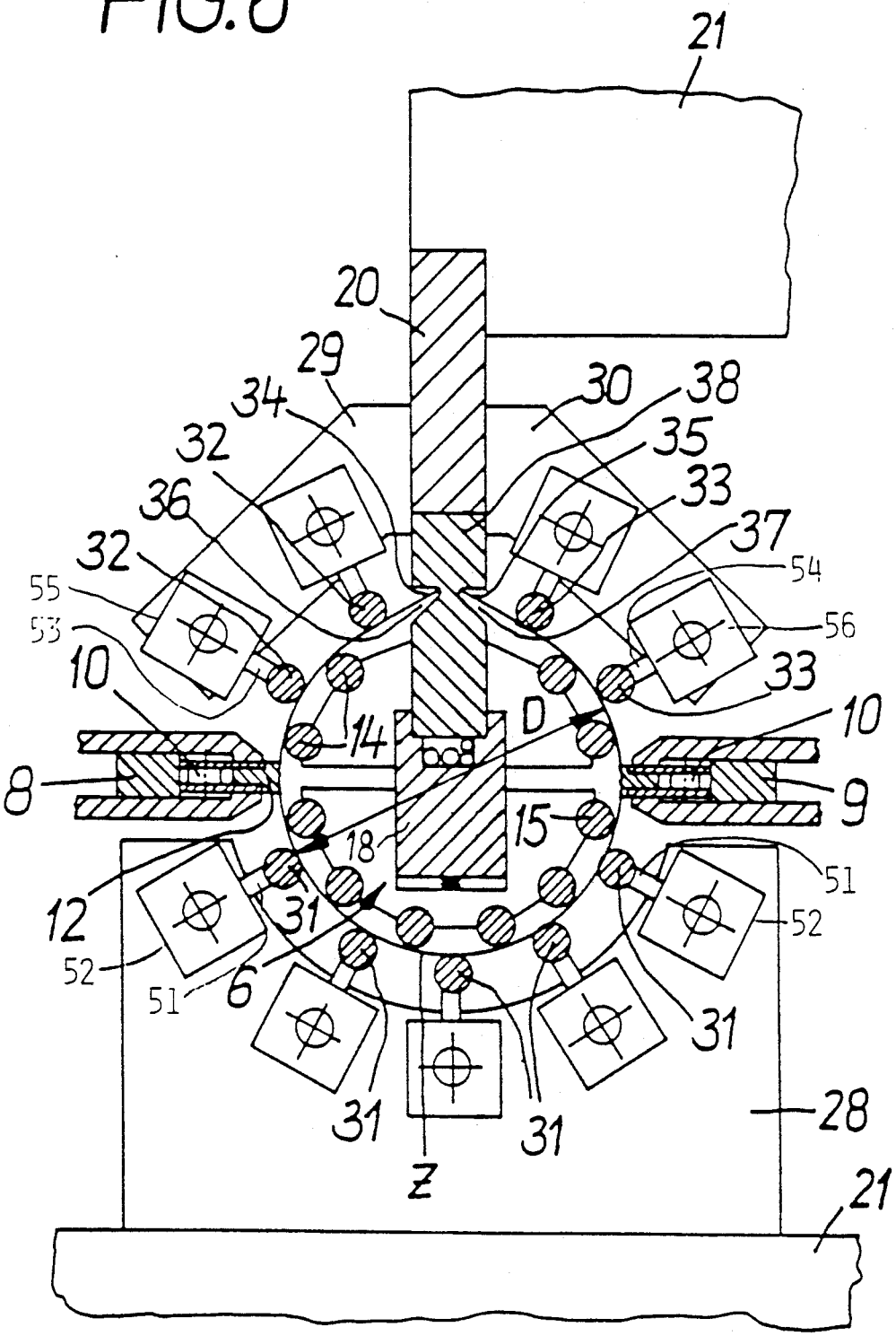
Figure 7:
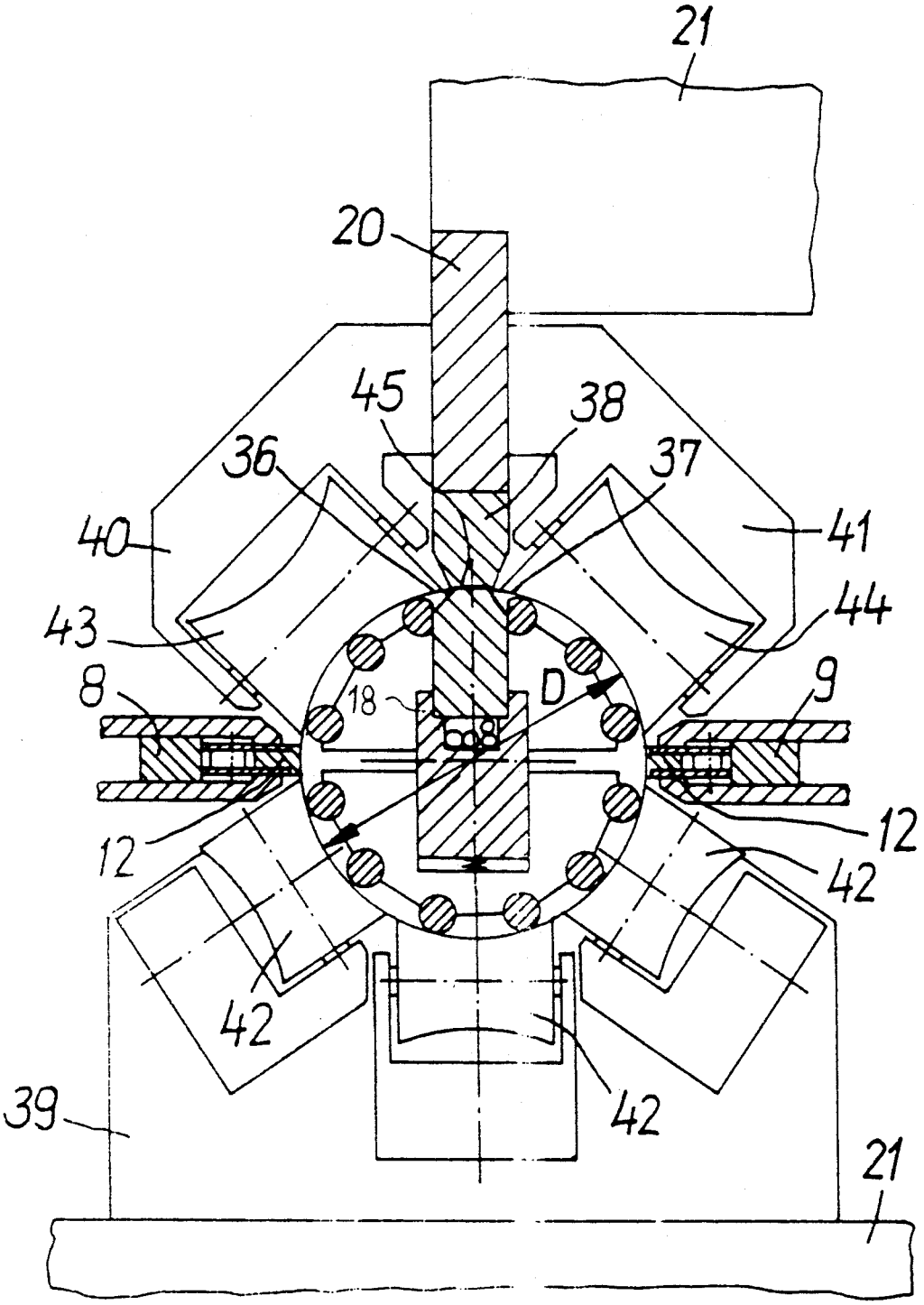

Referring in particular to FIGS. 1 and 2, the second transporting device 2 is composed of identical, mirror image advancing chain drives 8 and 9 which are disposed opposite one another in a plane to the sides of shaping mandrel 6. Pawls 11 and non-elastic supports 12 are fastened to the single roller chains 10 of advancing chain drives 8 and 9 so as to advance, support and guide the blanks Z whose center region is already completely shaped as illustrated in FIGS. 6 and 7. To compensate pitch errors and other manufacturing tolerances, chains 10 and their pawls 11 can be set to be flush with one another. Advancing chain drives 8, 9 can be adapted to the respective can diameter D by means of lifting elements 13 which adjust their height and by means of slide elements 49 which move them radially and horizontally.

Shaping mandrel 6 is composed of a plurality of round rods 14, 15 which are fastened so as to form a circle, at lower and upper supporting elements 16, 17. Rods 14 and 15 have different lengths. The lowermost round rods 15 are the longest and are provided at the beginning of shaping path F. With progressive shaping of blanks Z, other round rods 14 and 15, respectively, are added as illustrated in the successive FIGS. 3–7. The uppermost round rods 14 are the shortest and start shortly before (upstream of) the second transporting device 2. The lower half of shaping mandrel 6, composed of round rods 15 fastened to supporting elements 17, can be slightly changed in height relative to the upper half of shaping mandrel 6 which is composed of rods 14 that are fastened to supporting elements 16 and can thus be set precisely to a given can diameter D.

Figure 3:
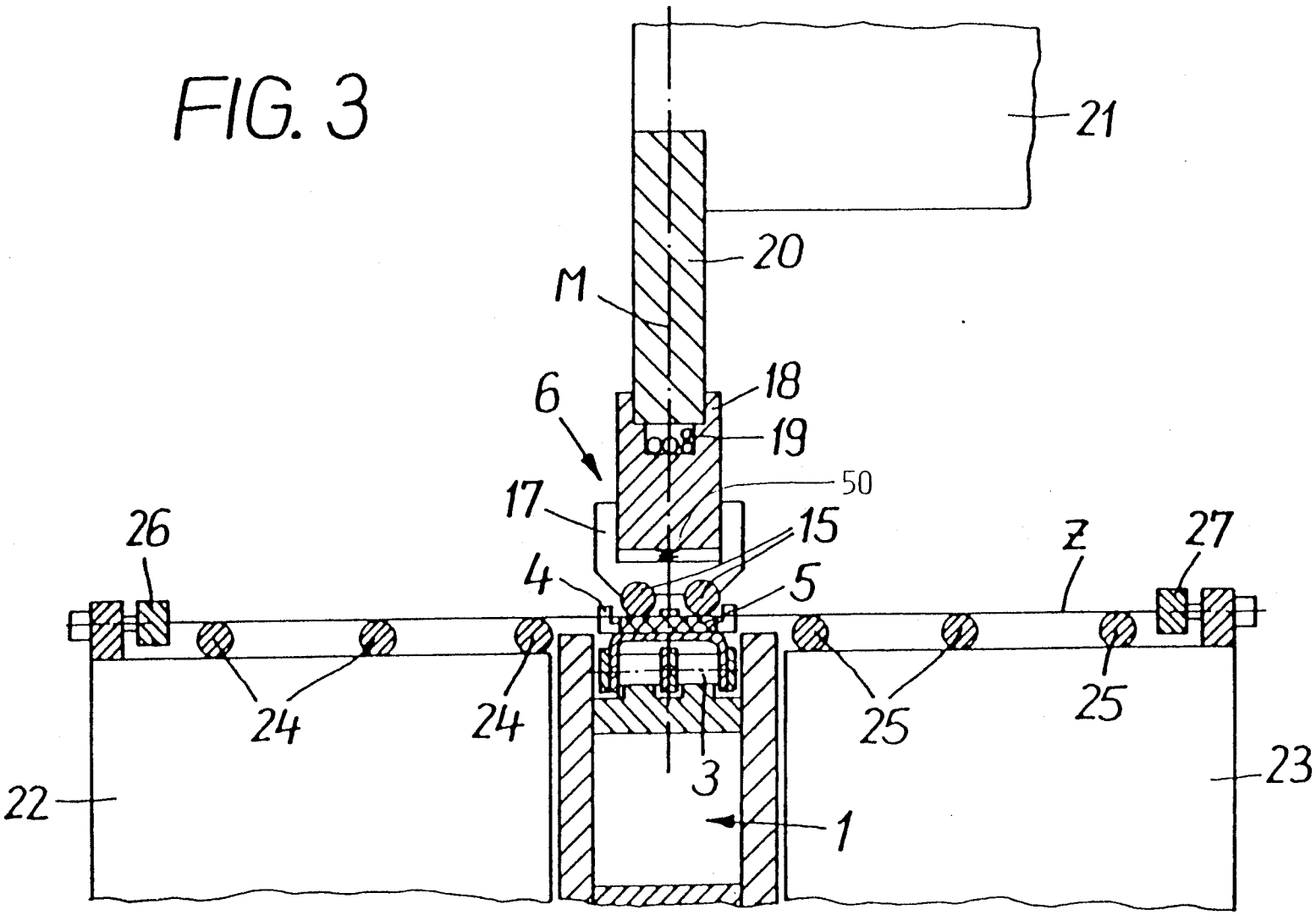
FIGS. 3 to 7 are enlarged sectional views taken along lines III—III to VII—VII of FIG. 1, respectively.

Also referring to FIG. 3, which shows the start of shaping path F, supporting elements 16 and 17 are fastened in a profiled lower arm member 18 which includes an integrated cable and hose channel 19. Profiled lower arm member 18 is attached to frame 21 by way of an intermediate member 20. As shown in FIG. 3, a spring 50 is disposed between supporting element 17 and profiled lower arm 18 and a screw (not shown) or other suitable device can be provided for adjusting and fixing the height of the lower half of shaping mandrel 6 relative to the upper half of shaping mandrel 6 as will be readily apparent to those skilled in the art.

Blank Z rests on rods 24, 25 of a right and left guide basket, respectively, which are fastened to supporting elements 22, and 23 and on the elastic chain supports 5 of the first transporting device 1. Rods 24 and 25 are, at that location, still disposed in a horizontal orientation. Supporting elements 22 and 23 are connected by means of right and left supports 22' and 23' (FIG. 2) and are fastened through them to frame 21.

Figure 4:
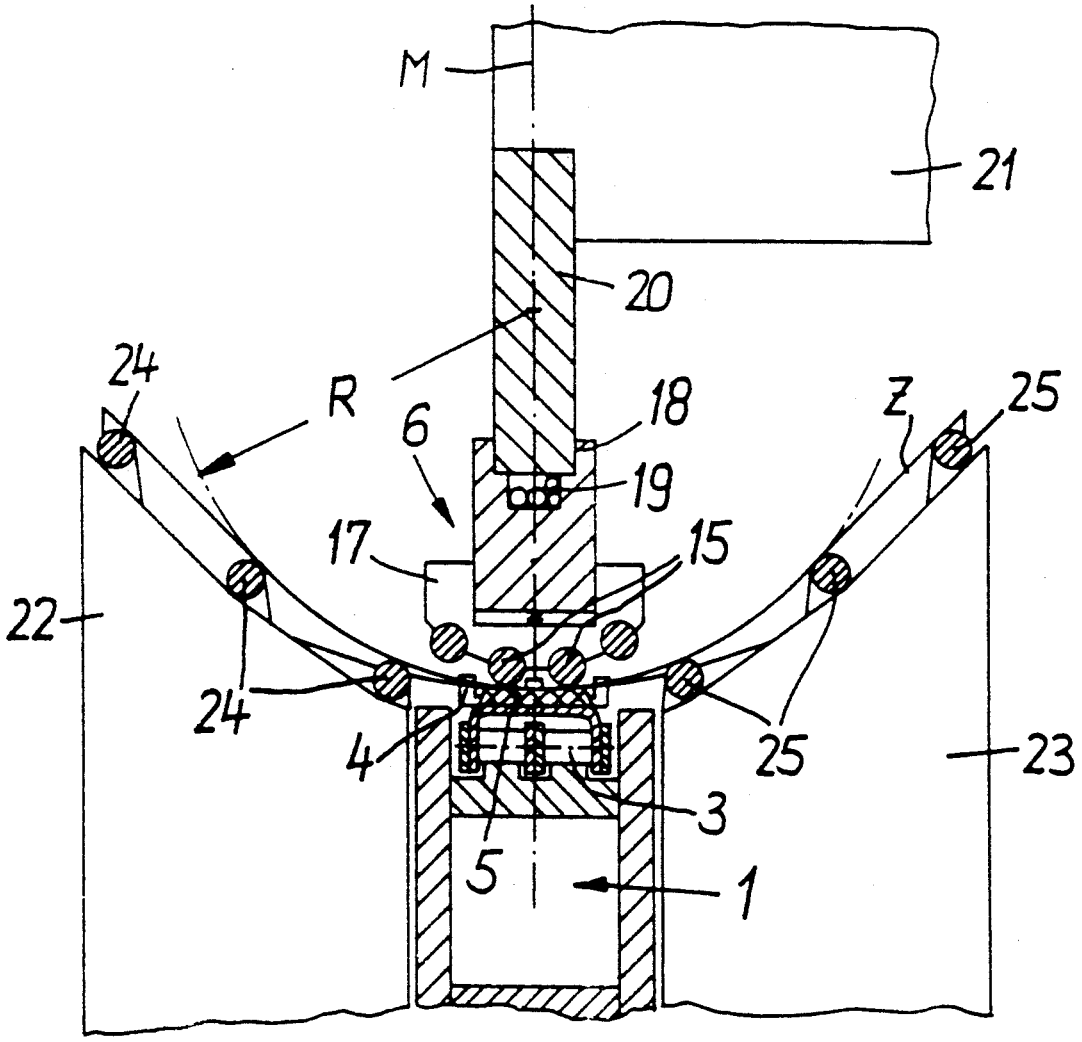

Blank Z is centered and aligned by means of lateral guides 26 and 27 whose spacing and orientation can be finely adjusted. To advance, blank Z is gripped and pushed by a pawl 4. In order to stabilize the advance, pawl 4 is provided with three projections, as illustrated in FIGS. 3 and 4, so that blank Z is gripped over a certain part of its width. Some of the projections of pawl 4 grip between rods 15 of shaping mandrel 6. At the beginning of shaping path F, only the two lower rods 15 of shaping mandrel 6 come in contact with blank Z.

FIG. 4 illustrates the center zone of guide baskets 22, 24 and 23, 25, respectively. While the side sections of blank Z are still extending in a planar, unbent manner, the center region of blank Z is already bent. The forced deformation of blank Z causes it to be clamped by friction forces firmly between the two lower rods 15 of shaping mandrel 6 and the elastic chain supports 5 which are provided with a well adhering surface. The two still unshaped side sections of blank Z follow tangentially the center arcuate region of blank Z having a radius R which equals one half the desired can diameter D.

Figure 5:
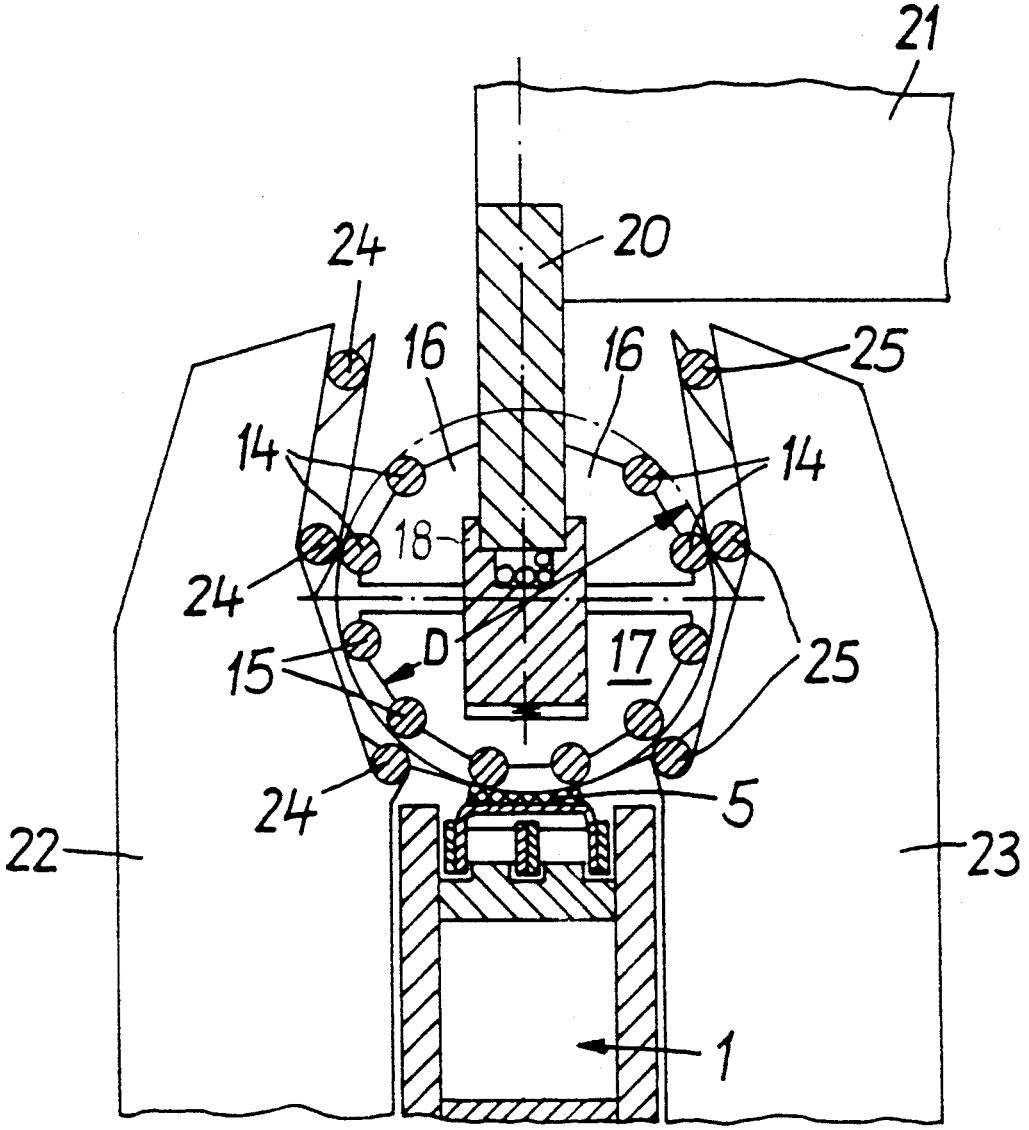

The two lateral guide baskets 22, 24 and 23, 25 end essentially together with the first transporting device between cross-sections V and VI. Toward the end as illustrated in FIG. 5, the center region of blank Z is completely bent over a circumference of about 180°. The blank now lies against the entire lower half of shaping mandrel 6 formed of rods 15. The two still unshaped planar side sections of blank Z which each still correspond to a circumferential length of about 90° follow tangentially the center arcuate section of the blank which has a radius of R. At this point, blank Z is engaged and advanced by the second transporting device 2 as illustrated in FIG. 6, which includes the two advancing chain drives 8 and 9, with their rigid supports 12 taking over the lateral guidance of blank 2 in a horizontal orientation instead of the guide rods 24, 25.

FIG. 6, showing a zone farther along in the direction of advance, illustrates a lower rod guide tool equipped with guide rods 31 attached to short rods 51 plugged into holders 52, the latter being fastened to supporting elements 28 and two lateral upper rod guide tools including guide rods 32 and 33, respectively, attached to short rods 53 and 54 plugged into respective holders 55 and 56, the latter being fastened to supporting elements 29 and 30 in a second section of the outer shaping cage. The circle with the cross hair shown in the holders 52, 55 and 56 is intended to symbolize a hinge about which each holder on supporting elements 28, 29 and 30 can rotate for fixing the positions of the guide rods 31, 32 and 33. Guide rods 31 of the lower rod guide tool extend parallel to shaping mandrel 6 and are set in their radial orientation so that blank Z lies against the rods 15 of the lower section of shaping mandrel 6. Guide rods 31 are arranged, as viewed in the circumferential direction, offset with respect to rods 15 of shaping mandrel 6. Rods 32 and 33 of the upper lateral rod guide cage are arranged to converge in such a manner that the end regions of blank Z, upon its further advance are bent into the upper region of shaping mandrel 6 and against rods 14. The edges 34 and 35 of the side sections of blank Z thus enter into oppositely disposed grooves 36 and 37 of a grooved rail 38 disposed between profiled lower arm member 18 and intermediate member 20. In the direction of advance, the distance between the two grooves 36 and 37 decreases continuously until blank Z is completely bent around shaping mandrel 6 and has assumed a closed, circular cross section of a diameter D as illustrated in FIG. 7. Moreover, the exterior of the completely bent blank Z is fully enclosed by roller guide tools 39, 40, 41, the rigid supports 12 of chains 10 of advancing chain drives 8 and 9 and the guide grooves 36, 37 of grooved rail 38. The sectional view illustrated in FIG. 7 shows a zone immediately upstream of a welding location S (FIG. 1).

Rollers 42, 43, 44 of roller guide tools 39, 40, 41 are of a concave surface precisely adapted to the circular cross section of bent blank Z (can body). Rollers 42, 43, 44 can be suitably individually adjusted in their radial orientation, as understood by those skilled in the art, so that the edges 34 and 35 of rounded blank Z lie against one another with pressure at butt location 45. As illustrated in FIG. 1, at the end of grooved rail 38, below and above the plane of the grooves, there is provided slide skid 46 and 47, respectively, which are adjustable in height so as to orient the edges 34 and 35 of the blanks to be precisely flush in height.

Downstream of the conveying flow, immediately behind slide skids 46 and 47, there is situated the welding station S, with the welding being effected, for example, by means of a focused laser beam 48.

It will be understood that the above description of the present invention is susceptible to various modifications, changes and adaptations, and the same are intended to be comprehended within the meaning and range of equivalents of the appended claims.

What is claimed is:

1. A method of producing can bodies from individual, planar cut blanks having a central region bordered by two lateral regions, the method comprising the following steps:

(a) transporting the blank into a shaping station by a first transporting means which engages the central region of the blank at its trailing edge;

(b) bending, to a final shape, solely the central region of the blank around an inner shaping mandrel to a circumferential angle of 120° to 190° while leaving the lateral regions unbent;

(c) clamping, simultaneously with step (b), said central region between said mandrel and said transporting means by way of friction forces derived from the forced deformation of the central region;

(d) transporting the blank for further shaping, after step (b), by a second transporting means which engages the trailing edge of said blank at two lateral locations on respective sides of said central region, said two lateral locations having already received the shape of the final can body as a result of step (b);

(e) bending, after step (b), said lateral regions of said blank;

(f) guiding opposite longitudinal side edges of said blank into an adjoining position;

(g) forming a longitudinal seam along the adjoining side edges; and (h) continuously linearly advancing the blank during steps (a) through (g).

2. A method as defined in claim 1, wherein said circumferential angle is approximately 180°.

3. A method as defined in claim 1, wherein step (a) comprises the step of engaging the trailing edge of the blank in a central region, over a distance which corresponds to at least 1/10 of the width of the blank, measured transversely to a direction of advance of the blank.

4. An apparatus for forming a can body from individual planar blanks comprising:

a frame, an outer elongated shaping cage attached to said frame, and including a plurality of longitudinal elements and having an entrance end and an exit end, an inner shaping mandrel comprised of individual, axially parallel guide rods positioned within said cage, and having a longitudinal center axis and a cross-sectional outline perpendicular to said axis corresponding to the desired inner cross-sectional shape of said can body, wherein an underside of the shaping mandrel has a central recess;

first transporting means for transporting said blank between said cage and said mandrel, extending over a first portion of the length of said shaping mandrel in its axial direction, said first transporting means being equipped with pawls extending into said recess of said shaping mandrel and with engaging means for engaging said blank between said transporting means and said shaping mandrel, means for guiding the edges of the can body, said longitudinal elements at said entrance end of said outer shaping cage forming an initial plane extending at least one blank width tangential to said mandrel, said longitudinal elements being gradually curved to surround said mandrel at said exit end of said cage in the shape of said can body, and second transporting means extending over a second portion of the length of said mandrel in said axial direction, for transporting said blank between said cage and said mandrel and out of said exit end, said second transporting means including two advancing means, each arranged laterally of a longitudinal center plane of the mandrel, for engaging and advancing said blank.

5. An apparatus as defined in claim 4, wherein the pawls of said first transporting means have a blank contacting surface of at least 1/10 of the width of the blank.

6. An apparatus as defined in claim 4, wherein said second transporting means are disposed in a plane extending through the central axis of said mandrel and said can body.

7. An apparatus as defined in claim 4, wherein said mandrel is comprised of individual, axially parallel guide rods arranged in a configuration corresponding to the inner cross-sectional outline of the finished can body, wherein said central recess lies between a first two guide rods dispose adjacent said initial plane.

8. An apparatus as defined in claim 7, wherein the guide rods of said mandrel farthest from said initial plane extend over a shorter portion of the length of said central axis than said first two guide rods.

9. An apparatus as defined in claim 7, further including upper and lower supporting elements for supporting said guide rods.

10. An apparatus as defined in claim 9, wherein said upper and lower supporting elements are adjustable relative to one another.

11. An apparatus as defined in claim 4, wherein said longitudinal elements adjacent said entrance end form a first part of the outer shaping cage and are curved gradually upwardly form said initial plane toward a longitudinal center plane intersecting said central axis such that an imaginary curve enclosed by the cage interior corresponds to a lower portion of the finished can body, and further including supporting elements connecting said longitudinal elements to said frame.

12. An apparatus as defined in claim 4, further including a plurality of rollers disposed proximate to said exit end.

13. An apparatus as defined in claim 12, further including upper lateral roller guides and a lower roller guide, each of said roller guides being individually mounted to said frame, wherein each of said rollers is attached to one of said roller guides.

14. An apparatus as defined in claim 13, wherein said roller guides are adjustably mounted to said frame.

15. An apparatus as defined in claim 12, wherein said rollers have a concave outer surface complementary to the shape of the can body.

16. An apparatus as defined in claim 14, further including a plurality of upper and lower supporting means for positioning said longitudinal elements of said cage.

17. An apparatus as defined in claim 16, wherein said upper and lower supporting means are individually adjustable for independently positioning said longitudinal elements of said cage.

18. An apparatus as defined in claim 4, wherein said first transporting means includes a double roller chain.

19. An apparatus as defined in claim 4, further including lifting means attaching said first transporting means to said frame, for adjusting the relative position between said first transporting means and said cage and mandrel.

20. An apparatus as defined in claim 4, wherein the two advancing means of said second transporting means each include a single roller chain.

21. An apparatus as defined in claim 4 further including lifting means attaching said second transporting means to said frame, for adjusting the relative position between said second transporting means and said cage and mandrel.

22. An apparatus as defined in claim 4, further including a lower slide skid and an upper slide skid disposed adjacent said exit end.

* * * * *